US007255630B2

(12) United States Patent
Elledge

(10) Patent No.: US 7,255,630 B2
(45) Date of Patent: Aug. 14, 2007

(54) METHODS OF MANUFACTURING CARRIER HEADS FOR POLISHING MICRO-DEVICE WORKPIECES

(75) Inventor: Jason B. Elledge, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 107 days.

(21) Appl. No.: 11/187,280

(22) Filed: Jul. 22, 2005

(65) Prior Publication Data

US 2005/0255792 A1 Nov. 17, 2005

Related U.S. Application Data

(62) Division of application No. 10/925,599, filed on Aug. 23, 2004, now Pat. No. 7,033,251, which is a division of application No. 10/346,233, filed on Jan. 16, 2003.

(51) Int. Cl.
*B24B 7/22* (2006.01)

(52) U.S. Cl. ..... 451/8; 451/11; 451/41; 451/288

(58) Field of Classification Search ..... 451/8, 451/9, 11, 36, 41, 287–290, 494, 550, 905
See application file for complete search history.

(56) References Cited

U.S. PATENT DOCUMENTS 5,036,015 A 7/1991 Sandhu et al.
5,069,002 A 12/1991 Sandhu et al.
5,081,796 A 1/1992 Schultz
5,222,875 A 6/1993 Clark
5,232,875 A 8/1993 Tuttle et al.
5,234,867 A 8/1993 Schultz et al.
5,240,552 A 8/1993 Yu et al.
5,244,534 A 9/1993 Yu et al.
5,245,790 A 9/1993 Jerbic
5,245,796 A 9/1993 Miller et al.
RE34,425 E 11/1993 Schultz
5,413,941 A 5/1995 Koos et al.

(Continued)

OTHER PUBLICATIONS

Carlson, J. David, "What Makes a Good MR Fluid?" pp. 1-7, 8th Annual International Conference on Electrorheological (ER) Fluids and Magneto-rheological (MR) Suspensions, Nice, France, Jul. 9-13, 2001.

(Continued)

*Primary Examiner*—Lee D. Wilson
*Assistant Examiner*—Anthony Ojini
(74) *Attorney, Agent, or Firm*—Perkins Coie LLP

(57) ABSTRACT

Carrier assemblies, polishing machines with carrier assemblies, and methods for mechanical and/or chemical-mechanical polishing of micro-device workpieces are disclosed herein. In one embodiment, a carrier assembly includes a head having a chamber, a magnetic field source carried by the head, and a magnetic fluid in the chamber. The magnetic field source is configured to generate a magnetic field in the head. The magnetic fluid changes viscosity within the chamber under the influence of the magnetic field to exert a force against at least a portion of the micro-device workpiece. The magnetic fluid can be a magnetorheological fluid. The magnetic field source can include an electrically conductive coil and/or a magnet, such as an electromagnet. The carrier assembly can also include a fluid cell with a cavity to receive the magnetic fluid.

18 Claims, 6 Drawing Sheets

U.S. PATENT DOCUMENTS 5,421,769 A 6/1995 Schultz et al.
5,433,651 A 7/1995 Lustig et al.
5,439,551 A 8/1995 Meikle et al.
5,449,314 A 9/1995 Meikle et al.
5,486,129 A 1/1996 Sandhu et al.
5,514,245 A 5/1996 Doan et al.
5,533,924 A 7/1996 Stroupe et al.
5,540,810 A 7/1996 Sandhu et al.
5,609,718 A 3/1997 Meikle
5,618,381 A 4/1997 Doan et al.
5,618,447 A 4/1997 Sandhu
5,643,048 A 7/1997 Iyer
5,643,053 A * 7/1997 Shendon ..... 451/28
5,643,060 A 7/1997 Sandhu et al.
5,658,183 A 8/1997 Sandhu et al.
5,658,186 A 8/1997 Perrotto et al.
5,658,190 A 8/1997 Wright et al.
5,663,797 A 9/1997 Sandhu
5,664,988 A 9/1997 Stroupe et al.
5,668,061 A 9/1997 Herko
5,679,065 A 10/1997 Henderson
5,681,215 A * 10/1997 Sherwood et al. ..... 451/388
5,700,180 A 12/1997 Sandhu et al.
5,702,292 A 12/1997 Brunelli et al.
5,730,642 A 3/1998 Sandhu et al.
5,738,562 A 4/1998 Doan et al.
5,747,386 A 5/1998 Moore
5,777,739 A 7/1998 Sandhu et al.
5,792,709 A 8/1998 Robinson et al.
5,795,495 A 8/1998 Meikle
5,798,302 A 8/1998 Hudson et al.
5,807,165 A 9/1998 Uzoh et al.
5,830,806 A 11/1998 Hudson et al.
5,836,807 A * 11/1998 Leach ..... 451/41
5,842,909 A 12/1998 Sandhu et al.
5,851,135 A 12/1998 Sandhu et al.
5,855,804 A 1/1999 Walker
5,868,896 A 2/1999 Robinson et al.
5,882,248 A 3/1999 Wright et al.
5,893,754 A 4/1999 Robinson et al.
5,895,550 A 4/1999 Andreas
5,910,846 A 6/1999 Sandhu
5,916,012 A 6/1999 Pant et al.
5,930,699 A 7/1999 Bhatia
5,931,718 A 8/1999 Komanduri et al.
5,931,719 A 8/1999 Nagahara et al.
5,934,980 A 8/1999 Koos et al.
5,936,733 A 8/1999 Sandhu et al.
5,945,347 A 8/1999 Wright
5,954,912 A 9/1999 Moore
5,967,030 A 10/1999 Blalock
5,972,792 A 10/1999 Hudson
5,980,363 A 11/1999 Meikle et al.
5,981,396 A 11/1999 Robinson et al.
5,994,224 A 11/1999 Sandhu et al.
5,997,384 A 12/1999 Blalock
6,007,408 A 12/1999 Sandhu
6,039,633 A 3/2000 Chopra
6,040,245 A 3/2000 Sandhu et al.
6,046,111 A 4/2000 Robinson
6,054,015 A 4/2000 Brunelli et al.
6,057,602 A 5/2000 Hudson et al.
6,059,638 A * 5/2000 Crevasse et al. ..... 451/41
6,066,030 A 5/2000 Uzoh
6,074,286 A 6/2000 Ball
6,083,085 A 7/2000 Lankford
6,108,092 A 8/2000 Sandhu
6,110,820 A 8/2000 Sandhu et al.
6,113,467 A * 9/2000 Koike ..... 451/41
6,116,988 A 9/2000 Ball
6,120,354 A 9/2000 Koos et al.
6,135,856 A 10/2000 Tjaden et al.
6,139,402 A 10/2000 Moore
6,143,123 A 11/2000 Robinson et al.
6,143,155 A 11/2000 Adams et al.
6,152,808 A 11/2000 Moore
6,176,992 B1 1/2001 Talieh
6,180,525 B1 1/2001 Morgan
6,184,571 B1 2/2001 Moore
6,187,681 B1 2/2001 Moore
6,190,494 B1 2/2001 Dow
6,191,037 B1 2/2001 Robinson et al.
6,191,864 B1 2/2001 Sandhu
6,193,588 B1 2/2001 Carlson et al.
6,200,901 B1 3/2001 Hudson et al.
6,203,404 B1 3/2001 Joslyn et al.
6,203,407 B1 3/2001 Robinson
6,203,413 B1 3/2001 Skrovan
6,206,754 B1 3/2001 Moore
6,206,756 B1 3/2001 Chopra et al.
6,206,769 B1 3/2001 Walker
6,208,425 B1 3/2001 Sandhu et al.
6,210,257 B1 4/2001 Carlson
6,213,845 B1 4/2001 Elledge
6,218,316 B1 4/2001 Marsh
6,224,466 B1 5/2001 Walker et al.
6,227,955 B1 5/2001 Custer et al.
6,234,868 B1 5/2001 Easter et al.
6,234,874 B1 5/2001 Ball
6,234,877 B1 5/2001 Koos et al.
6,234,878 B1 5/2001 Moore
6,237,483 B1 5/2001 Blalock
6,250,994 B1 6/2001 Chopra et al.
6,251,785 B1 6/2001 Wright
6,261,151 B1 7/2001 Sandhu et al.
6,261,163 B1 7/2001 Walker et al.
6,267,650 B1 7/2001 Hembree
6,273,786 B1 8/2001 Chopra et al.
6,273,796 B1 8/2001 Moore
6,276,996 B1 8/2001 Chopra
6,284,660 B1 9/2001 Doan
6,287,879 B1 9/2001 Gonzales et al.
6,290,572 B1 9/2001 Hofmann
6,297,159 B1 10/2001 Paton
6,301,006 B1 10/2001 Doan
6,306,012 B1 10/2001 Sabde
6,306,014 B1 10/2001 Walker et al.
6,306,768 B1 10/2001 Klein
6,312,558 B2 11/2001 Moore
6,313,038 B1 11/2001 Chopra et al.
6,319,420 B1 11/2001 Dow
6,323,046 B1 11/2001 Agarwal
6,328,632 B1 12/2001 Chopra
6,331,488 B1 12/2001 Doan et al.
6,338,667 B2 1/2002 Sandhu et al.
6,350,180 B2 2/2002 Southwick
6,350,691 B1 2/2002 Lankford
6,352,466 B1 3/2002 Moore
6,354,923 B1 3/2002 Lankford
6,354,928 B1 3/2002 Crevasse et al.
6,354,930 B1 3/2002 Moore
6,358,122 B1 3/2002 Sabde et al.
6,358,127 B1 3/2002 Carlson et al.
6,358,129 B2 3/2002 Dow
6,361,417 B2 3/2002 Walker et al.
6,362,105 B1 3/2002 Moore
6,364,746 B2 4/2002 Moore
6,364,757 B2 4/2002 Moore
6,368,190 B1 4/2002 Easter et al.
6,368,193 B1 4/2002 Carlson et al.
6,368,194 B1 4/2002 Sharples et al.
6,368,197 B2 4/2002 Elledge
6,376,381 B1 4/2002 Sabde
6,387,289 B1 5/2002 Wright

| | | | |
|---|---|---|---|
| 6,402,884 | B1 | 6/2002 | Robinson et al. |
| 6,402,978 | B1 | 6/2002 | Levin |
| 6,436,828 | B1 | 8/2002 | Chen et al. |
| 6,447,369 | B1 | 9/2002 | Moore |
| 6,482,077 | B1 | 11/2002 | Doan et al. |
| 6,579,799 | B2 | 6/2003 | Chopra et al. |
| 6,609,947 | B1 | 8/2003 | Moore |
| 2004/0038625 | A1 | 2/2004 | Elledge |
| 2004/0077292 | A1 | 4/2004 | Kim et al. |
| 2004/0142635 | A1 | 7/2004 | Chandrasekaran |
| 2004/0214514 | A1 | 10/2004 | Elledge |
| 2005/0026544 | A1 | 2/2005 | Elledge |
| 2005/0118390 | A1 | 6/2005 | Chandrasekaran |

OTHER PUBLICATIONS

Jolly, Mark R. et al., "Properties and Applications of Commercial Magnetorheological Fluids," 18 pages, SPIE 5th Annual International Symposium on Smart Structures and Materials, San Diego, California, Mar. 15, 1998.

Kondo, S. et al., "Abrasive-Free Polishing for Copper Damascene Interconnection," Journal of The Electrochemical Society, vol. 147, No. 10, pp. 3907-3913, 2000, The Electrochemical Society, Inc.

Lord Corporation, "Commercial Leader in MR Technology," 1 page, retrieved from the Internet on Jun. 14, 2002, <http://www.rheonetic.com>.

Lord Corporation, "Designing with MR Fluids," 5 pages, Engineering Note, Dec. 1999, Cary, North Carolina.

Lord Corporation, "Magnetic Circuit Design," 4 pages, Engineering Note, Nov. 1999, Cary, North Carolina.

Lord Corporation, "Magneto-Rheological Fluids References," 3 pages, retrieved from the Internet on Jun. 14, 2002, <http://www.rheonetic.com/tech_library/mr_fluid.htm>.

Lord Materials Division, "What is the Difference Between MR and ER Fluid?" 6 pages, Cary, North Carolina, presented May 2002.

* cited by examiner

METHODS OF MANUFACTURING CARRIER HEADS FOR POLISHING MICRO-DEVICE WORKPIECES

CROSS-REFERENCE TO RELATED APPLICATIONS

This application is a divisional of U.S. patent application Ser. No. 10/925,599, filed Aug. 23, 2004, now U.S. Pat. No. 7,033,251 which is a divisional of U.S. patent application Ser. No. 10/346,233, filed Jan. 16, 2003, and relates to co-pending U.S. patent application Ser. No. 10/226,571, filed Aug. 23, 2002, all of which are herein incorporated by reference.

TECHNICAL FIELD

The present invention relates to carrier assemblies, polishing machines including carrier assemblies, and methods for mechanical and/or chemical-mechanical polishing of micro-device workpieces.

BACKGROUND

Mechanical and chemical-mechanical planarization processes (collectively, "CMP") remove material from the surface of micro-device workpieces in the production of microelectronic devices and other products. FIG. 1 schematically illustrates a rotary CMP machine 10 with a platen 20, a carrier head 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The carrier head 30 has a lower surface 32 to which a micro-device workpiece 12 may be attached, or the workpiece 12 may be attached to a resilient pad 34 under the lower surface 32. The carrier head 30 may be a weighted, free-floating wafer carrier, or an actuator assembly 36 may be attached to the carrier head 30 to impart rotational motion to the micro-device workpiece 12 (indicated by arrow J) and/or reciprocate the workpiece 12 back and forth (indicated by arrow I).

The planarizing pad 40 and a planarizing solution 44 define a planarizing medium that mechanically and/or chemically-mechanically removes material from the surface of the micro-device workpiece 12. The planarizing solution 44 may be a conventional CMP slurry with abrasive particles and chemicals that etch and/or oxidize the surface of the micro-device workpiece 12, or the planarizing solution 44 may be a "clean" nonabrasive planarizing solution without abrasive particles. In most CMP applications, abrasive slurries with abrasive particles are used on non-abrasive polishing pads, and clean non-abrasive solutions without abrasive particles are used on fixed-abrasive polishing pads.

To planarize the micro-device workpiece 12 with the CMP machine 10, the carrier head 30 presses the workpiece 12 facedown against the planarizing pad 40. More specifically, the carrier head 30 generally presses the micro-device workpiece 12 against the planarizing solution 44 on a planarizing surface 42 of the planarizing pad 40, and the platen 20 and/or the carrier head 30 moves to rub the workpiece 12 against the planarizing surface 42. As the micro-device workpiece 12 rubs against the planarizing surface 42, the planarizing medium removes material from the face of the workpiece 12.

The CMP process must consistently and accurately produce a uniformly planar surface on the workpiece to enable precise fabrication of circuits and photo-patterns. A nonuniform surface can result, for example, when material from one area of the workpiece is removed more quickly than material from another area during CMP processing. To compensate for the nonuniform removal of material, carrier heads have been developed with expandable interior and exterior bladders that exert downward forces on selected areas of the workpiece. These carrier heads, however, have several drawbacks. For example, the typical bladder has a curved edge that makes it difficult to exert a uniform downward force at the perimeter. Moreover, conventional bladders cover a fairly broad area of the workpiece, thus limiting the ability to localize the downward force on the workpiece. Furthermore, conventional bladders are often filled with compressible air that inhibits precise control of the downward force. In addition, carrier heads with multiple bladders form a complex system that is subject to significant downtime for repair and/or maintenance, causing a concomitant reduction in throughput.

SUMMARY

The present invention is directed toward carrier assemblies, polishing machines with carrier assemblies, and methods for mechanical and/or chemical-mechanical polishing of micro-device workpieces. One aspect of the invention is directed to a carrier assembly for retaining a micro-device workpiece during mechanical or chemical-mechanical polishing. In one embodiment, the carrier assembly includes a head having a chamber, a magnetic field source carried by the head, and a magnetic fluid in the chamber. The magnetic field source is configured to generate a magnetic field in the head. The magnetic fluid changes viscosity within the chamber under the influence of the magnetic field to exert a force against at least a portion of the micro-device workpiece. In one aspect of this embodiment, the magnetic fluid is a magnetorheological fluid. In another aspect of this embodiment, the magnetic field source can include an electrically conductive coil and/or a magnet, such as an electromagnet. The magnet can be one of a plurality of magnets arranged concentrically, in quadrants, in a grid, or in other configurations. The electrically conductive coil can also be one of a plurality of coils. In another aspect of this embodiment, the carrier assembly can include a bladder with a cavity to receive the magnetic fluid. The carrier assembly can also include a plurality of bladders that are arranged concentrically, in quadrants, in a grid, or in other configurations.

Another aspect of the invention is directed to polishing machines for mechanical or chemical-mechanical polishing of micro-device workpieces. In one embodiment, the machine includes a table having a support surface, a polishing pad carried by the support surface of the table, and a workpiece carrier assembly having a carrier head configured to retain a workpiece and a drive system coupled to the carrier head. The carrier head can include a chamber, a magnetic field source, a fluid cell in the chamber, and a magnetic fluid in the fluid cell. The magnetic field source can selectively generate a magnetic field in the chamber causing the viscosity of the magnetic fluid to increase and exert a desired force against at least a portion of the micro-device workpiece. The drive system is configured to move the carrier head to engage the workpiece with the polishing pad.

Another aspect of the invention is directed to a method for polishing a micro-device workpiece with a polishing machine having a carrier head and a polishing pad. In one embodiment, the method includes moving at least one of the carrier head and the polishing pad relative to the other to rub the micro-device workpiece against the polishing pad. The carrier head includes a chamber and a magnetorheological fluid in the chamber. The method further includes exerting a force against a back side of the workpiece by generating a magnetic field in the carrier head that changes the viscosity of the magnetorheological fluid in the chamber of the carrier head.

DETAILED DESCRIPTION

The present invention is directed to carrier assemblies, polishing machines including carrier assemblies, and methods for mechanical and/or chemical-mechanical polishing of micro-device workpieces. The term "micro-device workpiece" is used throughout to include substrates in or on which microelectronic devices, micro-mechanical devices, data storage elements, and other features are fabricated. For example, micro-device workpieces can be semiconductor wafers, glass substrates, insulated substrates, or many other types of substrates. Furthermore, the terms "planarization" and "planarizing" mean either forming a planar surface and/or forming a smooth surface (e.g., "polishing"). Several specific details of the invention are set forth in the following description and in FIGS. 2–7D to provide a thorough understanding of certain embodiments of the invention. One skilled in the art, however, will understand that the present invention may have additional embodiments, or that other embodiments of the invention may be practiced without several of the specific features explained in the following description.

Figure 1:
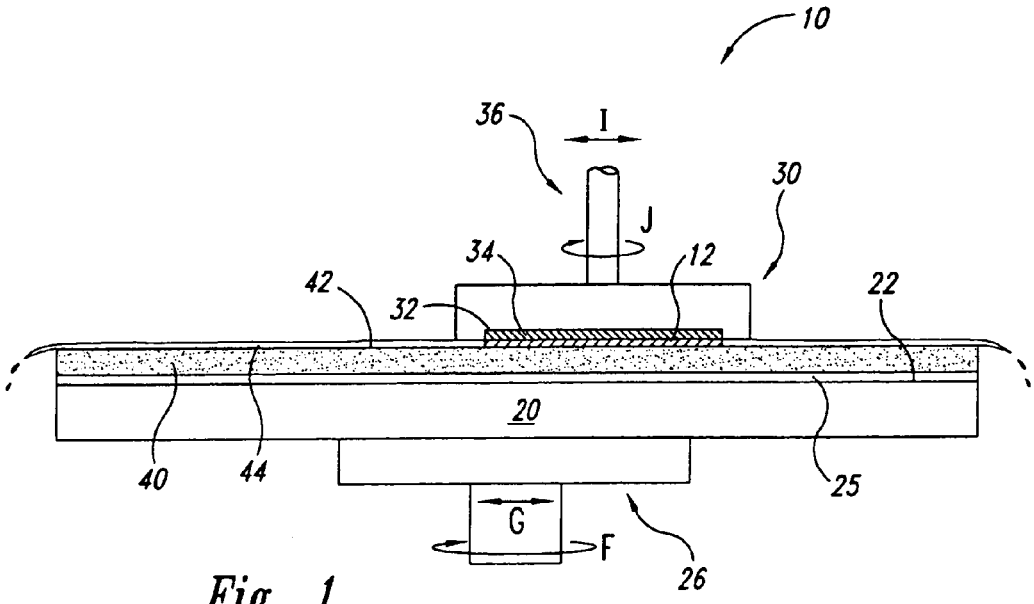
Fig. 1 (Prior Art)
FIG. 1 is a schematic cross-sectional side view of a portion of a rotary planarizing machine in accordance with the prior art.
Figure 2:
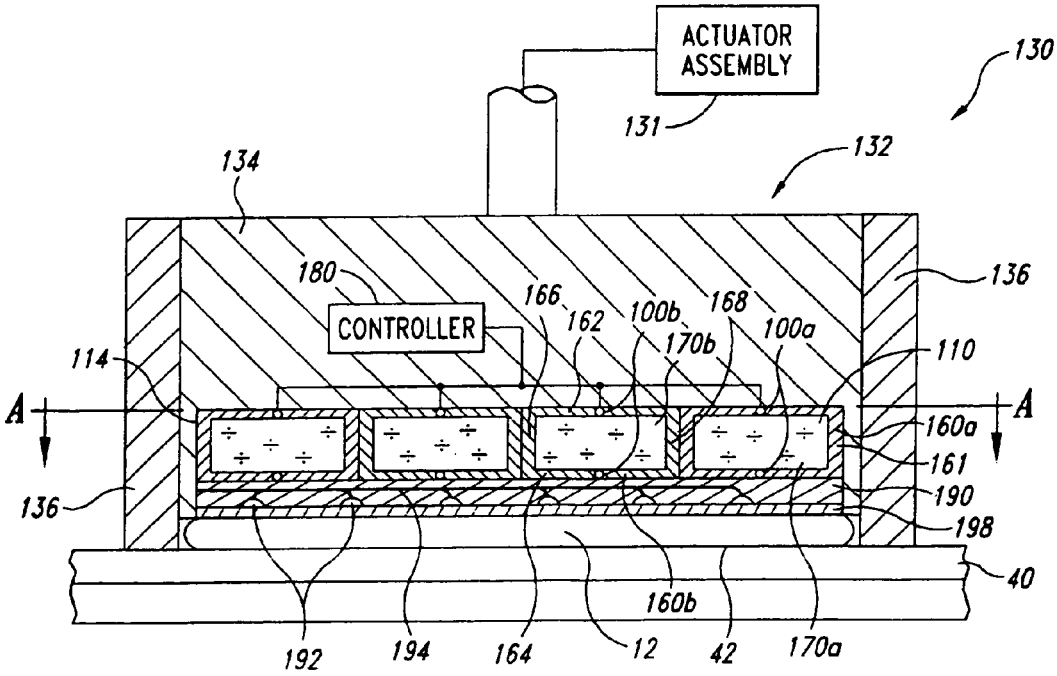
FIG. 2 is a schematic cross-sectional side view of a carrier assembly in accordance with one embodiment of the invention.

FIG. 2 is a schematic cross-sectional side view of a carrier assembly 130 in accordance with one embodiment of the invention. The carrier assembly 130 can be coupled to an actuator assembly 131 to move the workpiece 12 across the planarizing surface 42 of the planarizing pad 40. In the illustrated embodiment, the carrier assembly 130 includes a head 132 having a support member 134 and a retaining ring 136 coupled to the support member 134. The support member 134 can be an annular housing having an upper plate coupled to the actuator assembly 131. The retaining ring 136 extends around the support member 134 and projects toward the workpiece 12 below a bottom rim of the support member 134.

Figure 3:
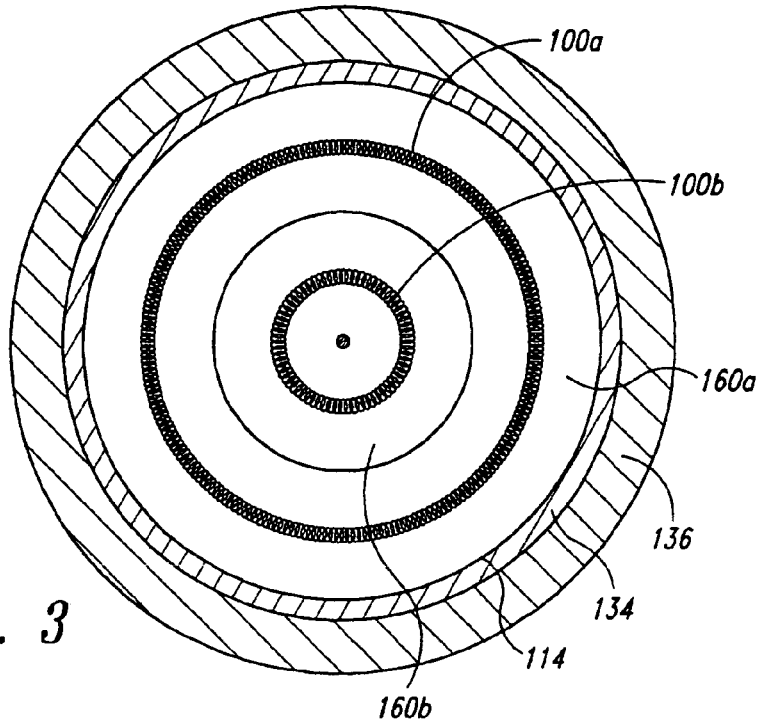
FIG. 3 is a schematic cross-sectional top view taken substantially along line A—A of FIG. 2.

In one aspect of this embodiment, the carrier assembly 130 includes a chamber 114 in the head 132, a first bladder 160*a* in the chamber 114, and a second bladder 160*b* in the chamber 114. The bladders 160 are fluid cells or fluid compartments that are suitable for containing fluid in discrete compartments within the head 132. FIG. 3 is a schematic cross-sectional top view taken substantially along line A—A of FIG. 2. The first and second bladders 160*a*–*b* each have an annular shape and are arranged concentrically with the first bladder 160*a* surrounding the second bladder 160*b*. In other embodiments, such as those described below with reference to FIGS. 5A–5C, the chamber 114 may contain a different number and/or configuration of bladders. In additional embodiments, the chamber 114 may not contain a bladder.

Referring to FIG. 2, each bladder 160 includes a membrane 161 and a cavity 170 (identified individually as 170*a*–*b*) defined by the membrane 161. The cavities 170 can contain a magnetic fluid 110, such as a magnetorheological fluid, that changes viscosity in response to a magnetic field. For example, in one embodiment, the viscosity of the magnetic fluid 110 can increase from a viscosity similar to that of motor oil to a viscosity of a nearly solid material depending upon the polarity and magnitude of a magnetic field applied to the magnetic fluid 110. In additional embodiments, the magnetic fluid 110 may experience a smaller change in viscosity in response to the magnetic field. In other embodiments, the viscosity of the magnetic fluid 110 may decrease in response to the magnetic field.

In another aspect of this embodiment, the carrier assembly 130 includes a first magnetic field source 100*a* and a second magnetic field source 100*b* that are each configured to generate magnetic fields in one of the cavities 170. For example, the first magnetic field source 100*a* can be carried by the first bladder 160*a* or the head 132 to selectively generate a magnetic field in the first cavity 170*a*, and the second magnetic field source 100*b* can be carried by the second bladder 160*b* or the head 132 to selectively generate a magnetic field in the second cavity 170*b*. In the illustrated embodiment, the magnetic field sources 100 each include a first electrically conductive coil embedded in the top surface 162 of the bladder 160 and a second electrically conductive coil embedded in the bottom surface 164 of the bladder 160. In other embodiments, a first side surface 166 and/or a second side surface 168 of each bladder 160 can carry the coils. In additional embodiments, the magnetic field sources 100 can include a different number of coils. In other embodiments, such as those described below with reference to FIGS. 6–7D, the carrier assembly 130 can include other magnetic field sources 100 to generate magnetic fields in the cavities 170.

In one aspect of the embodiment, a controller 180 is operatively coupled to the magnetic field sources 100 to selectively control the timing and strength of the magnetic fields in the cavities 170. The controller 180 can be an automatic process controller that adjusts the location and strength of the magnetic fields in real time based on the condition of the workpiece. The controller 180 can include an IC controller chip and a telematics controller.

The carrier assembly 130 can further include a flexible plate 190 and a flexible member 198 coupled to the flexible plate 190. The flexible plate 190 sealably encloses the bladders 160 in the chamber 114. In one aspect of this embodiment, the flexible plate 190 includes holes 192 and a vacuum line 194 coupled to the holes 192. The vacuum line 194 can be coupled to a vacuum source (not shown) to draw portions of the flexible member 198 into the holes 192, creating small suction cups across the back side of the workpiece 12 that hold the workpiece 12 to the flexible member 198. In other embodiments, the flexible plate 190 may not include the vacuum line 194 and the workpiece 12 can be secured to the carrier assembly 130 by another device. In the illustrated embodiment, the flexible member 198 is a flexible membrane. In other embodiments, the flexible member 198 can be a bladder or another device that prevents planarizing solution (not shown) from entering the chamber 114. In additional embodiments, the carrier assembly 130 may not include the flexible plate 190 and/or the flexible member 198.

Figure 4:
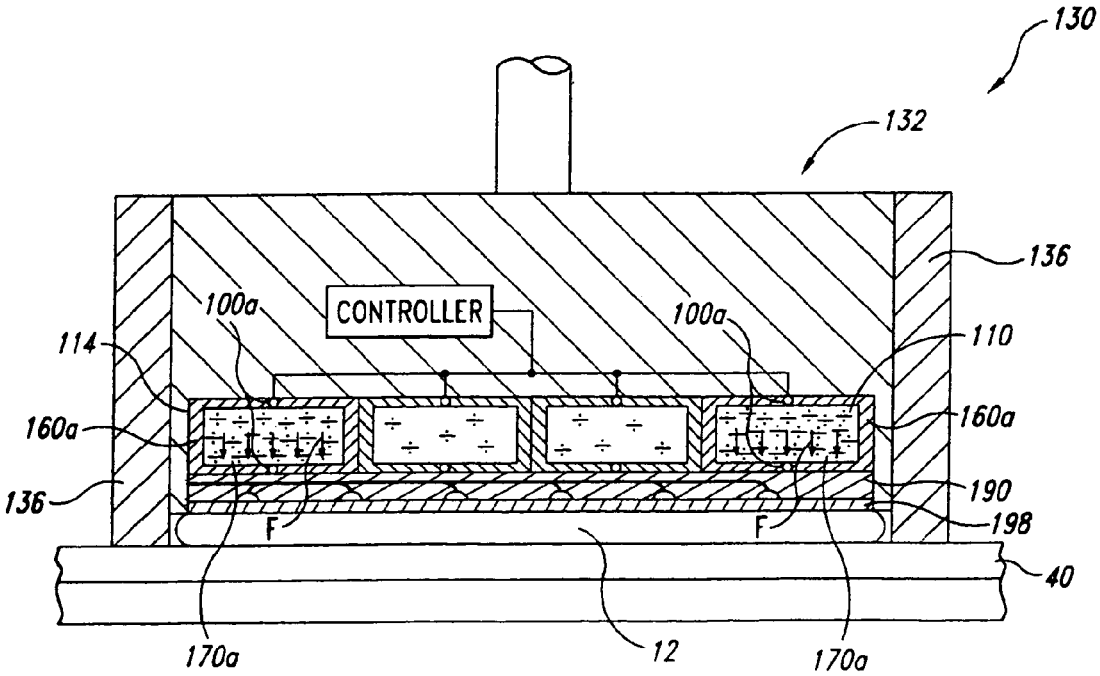
FIG. 4 is a schematic cross-sectional side view of the carrier assembly of FIG. 2 with a magnetic field applied in the first bladder.

FIG. 4 is a schematic cross-sectional side view of the carrier assembly 130 of FIG. 2 with a magnetic field applied in the first bladder 160*a*. In operation, the magnetic field sources 100 can selectively generate magnetic fields in the cavities 170 to exert discrete downward forces F on different areas of the workpiece 12. For example, in the illustrated embodiment, the first magnetic field source 100*a* generates a magnetic field in the first cavity 170*a*. The viscosity of the magnetic fluid 110 in the first bladder 160*a* increases in response to the magnetic field. The increased viscosity of the magnetic fluid 110 transmits a downward force F on the flexible plate 190 adjacent to the first bladder 160*a*. The force F flexes the flexible plate 190 and the flexible member 198 downward and is accordingly applied to a perimeter region of the workpiece 12.

The magnitude of the force F is determined by the strength of the magnetic field, the type of magnetic fluid 110, the amount of magnetic fluid 110 in the bladder 160, and other factors. The greater the magnetic field strength, the greater the magnitude of the force F. The location of the force F and the area over which the force F is applied to the workpiece 12 are determined by the location and size of the magnetic field and the bladder 160. In other embodiments, a plurality of discrete forces can be applied concurrently to the workpiece 12. As discussed above, the magnetic field sources 100 can generate magnetic fields and the associated forces in real time based on the profile of the workpiece. Furthermore, if previously polished workpieces have areas with consistent high points, the carrier assembly 130 can exert a greater downward force in those areas compared to low points to create a more uniformly planar surface on the workpiece.

Figure 5A:
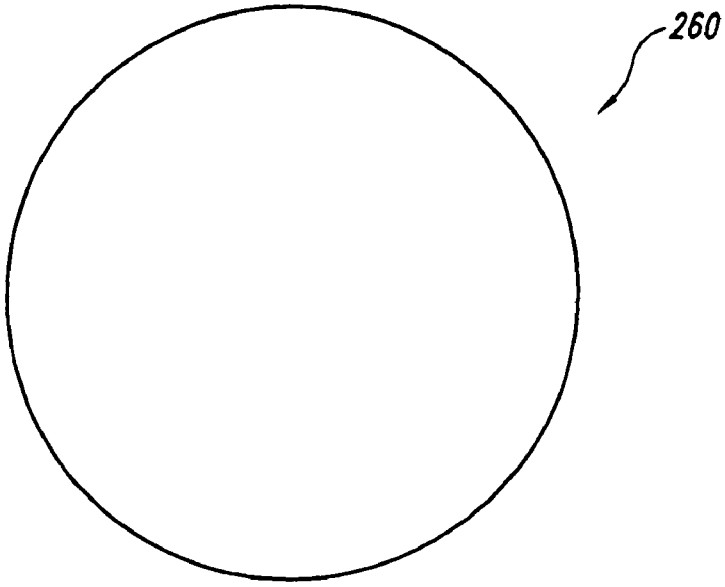
FIG. 5A is a schematic top view of a single circular bladder in accordance with another embodiment of the invention.
Figure 5B:
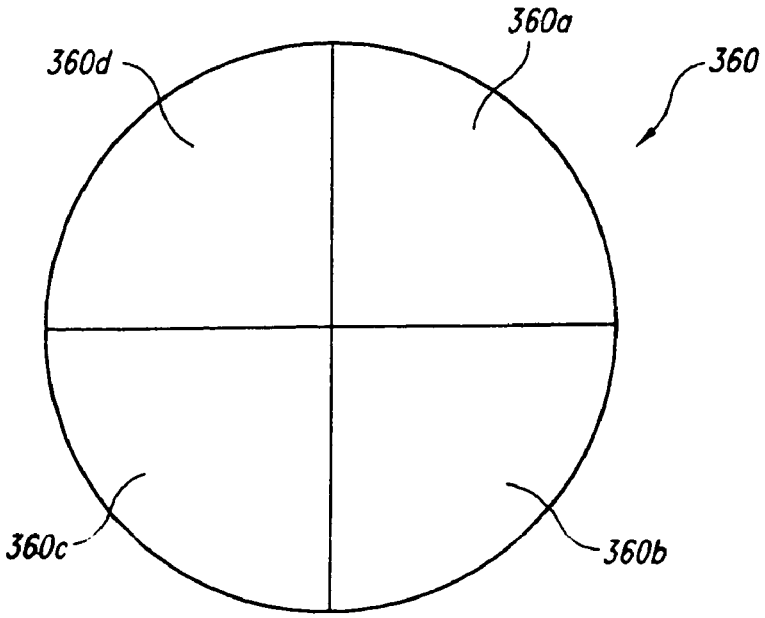
FIG. 5B is a schematic top view of a plurality of bladders arranged in quadrants in accordance with another embodiment of the invention.
Figure 5C:
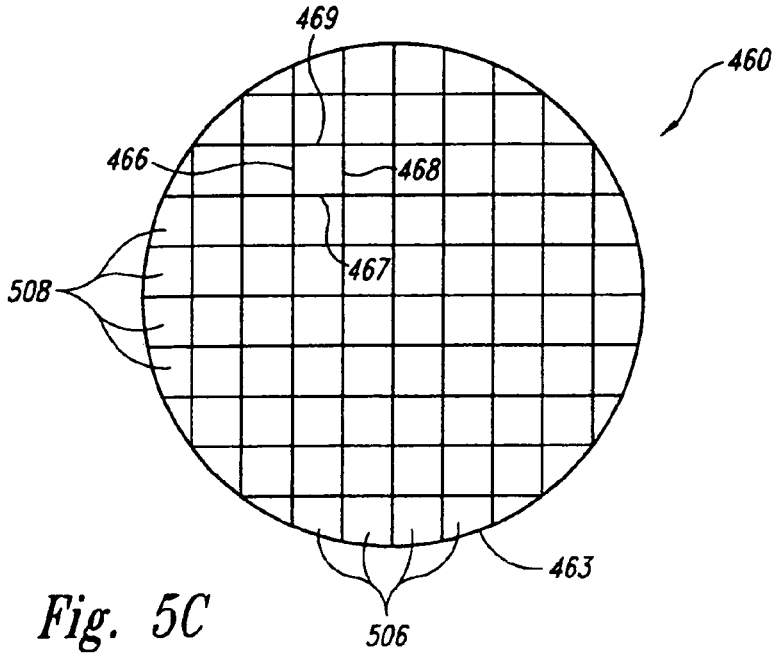
FIG. 5C is a schematic top view of a plurality of bladders arranged in a grid in accordance with another embodiment of the invention.

FIGS. 5A–5C are schematic top views of various bladders for use with carrier assemblies in accordance with additional embodiments of the invention. For example, FIG. 5A illustrates a single circular bladder 260 having a cavity to receive a magnetic fluid. FIG. 5B is a schematic top view of a plurality of bladders 360 (identified individually as 360*a*–*d*) in accordance with another embodiment of the invention. The bladders 360 include a first bladder 360*a*, a second bladder 360*b*, a third bladder 360*c*, and a fourth bladder 360*d* forming quadrants of a circle. Each bladder 360 has a separate cavity to receive a magnetic fluid.

FIG. 5C is a schematic top view of a plurality of bladders 460 in accordance with another embodiment of the invention. The bladders 460 are arranged in a grid with columns 506 and rows 508. Each bladder 460 has a first side 466, a second side 467, a third side 468, and a fourth side 469, and each bladder 460 has a cavity to receive a magnetic fluid. The first side 466 of one bladder 460 can contact or be spaced apart from the third side 468 of an adjacent bladder 460. In the illustrated embodiment, the bladders 460 proximate to the perimeter have a curved side 463 corresponding to the curvature of the chamber 114 (FIG. 2) in the carrier assembly 130 (FIG. 2). In other embodiments, the bladders can have other configurations, such as a hexagonal or pentagonal shape.

Figure 6:
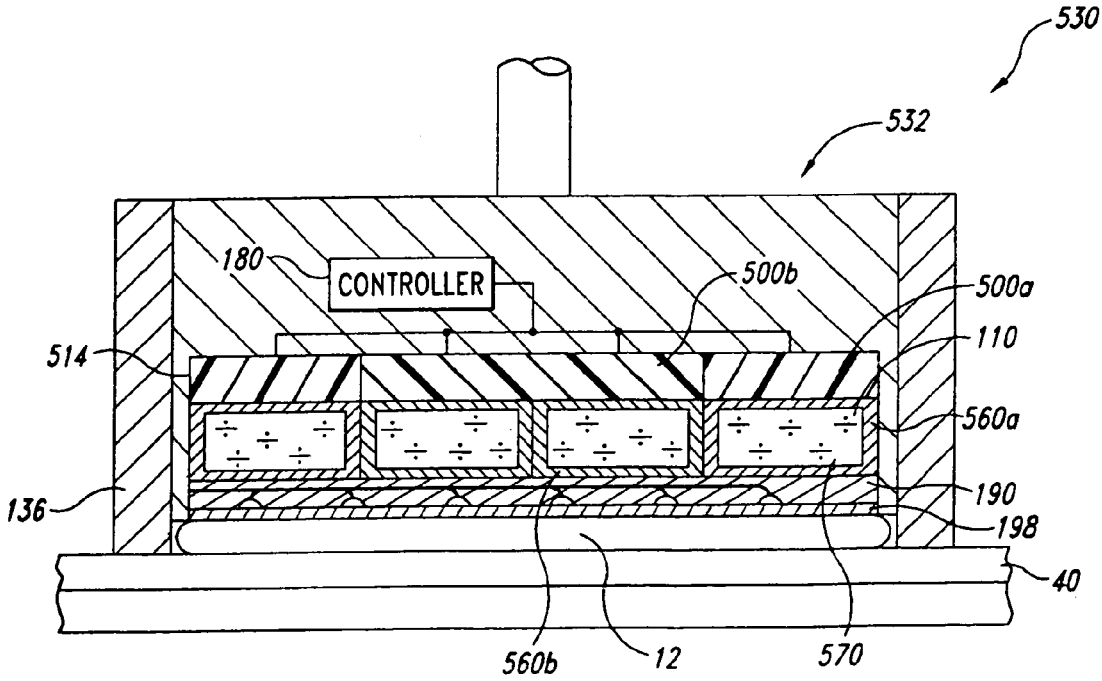
FIG. 6 is a schematic cross-sectional side view of a carrier assembly in accordance with another embodiment of the invention.

FIG. 6 is a schematic cross-sectional side view of a carrier assembly 530 in accordance with another embodiment of the invention. The carrier assembly 530 is similar to the carrier assembly 130 described above with reference to FIG. 2. For example, the carrier assembly 530 includes a head 532, a chamber 514 in the head 532, a first bladder 560*a* in the chamber 514, and a second bladder 560*b* in the chamber 514. The first and second bladders 560*a*–*b* each include a cavity 570 containing the magnetic fluid 110. The carrier assembly 530 also includes a first magnetic field source 500*a* carried by the first bladder 560*a* and a second magnetic field source 500*b* carried by the second bladder 560*b*. In one aspect of this embodiment, the first magnetic field source 500*a* has an annular shape and surrounds the second magnetic field source 500*b*. Each magnetic field source 500 can be a permanent magnet, an electromagnet, an electrical coil, or any other device that creates a magnetic field in the cavities 570. In additional embodiments, the magnetic field sources can be a single source or a plurality of sources with various configurations, such as those discussed below with reference to FIGS. 7A–7D. In other embodiments, the magnetic field sources can be external to the chamber 514, such as being positioned in or above the head 532.

Figure 7A:
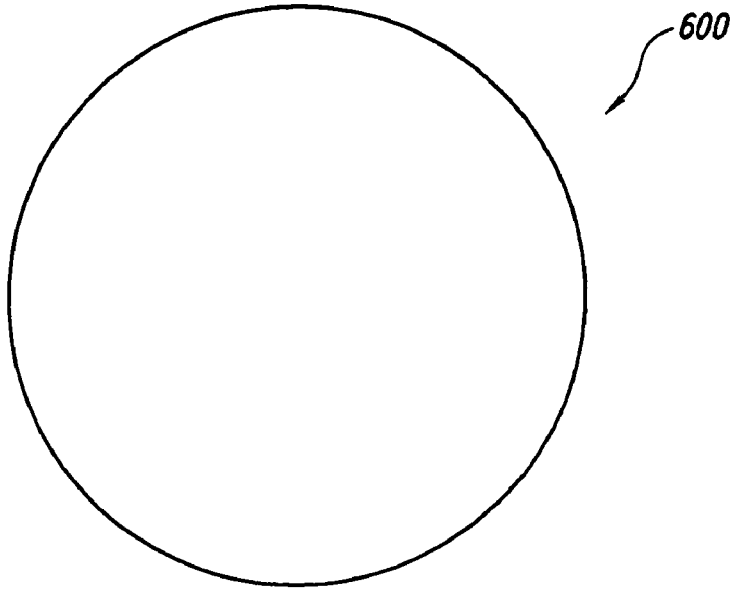
FIG. 7A is a schematic top view of a single circular magnetic field source in accordance with one embodiment of the invention.
Figure 7B:
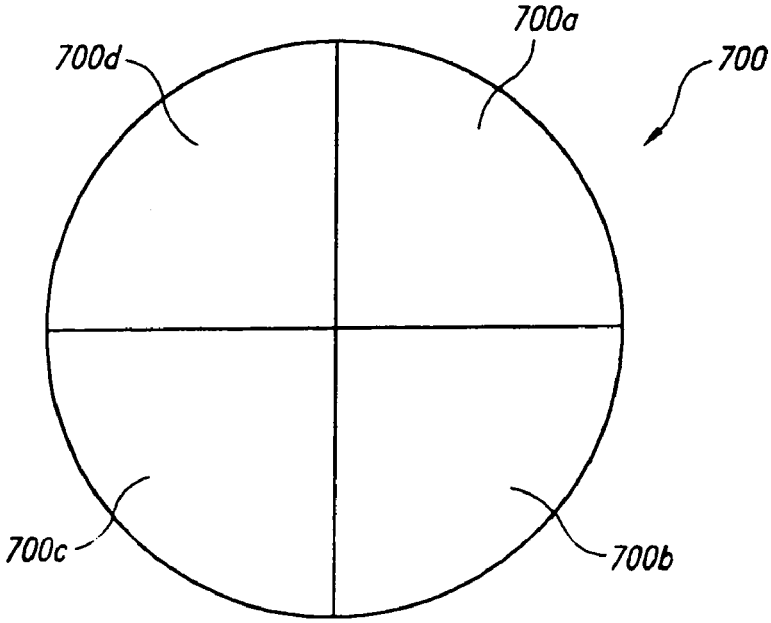
FIG. 7B is a schematic top view of a plurality of magnetic field sources arranged in quadrants in accordance with another embodiment of the invention.
Figure 7C:
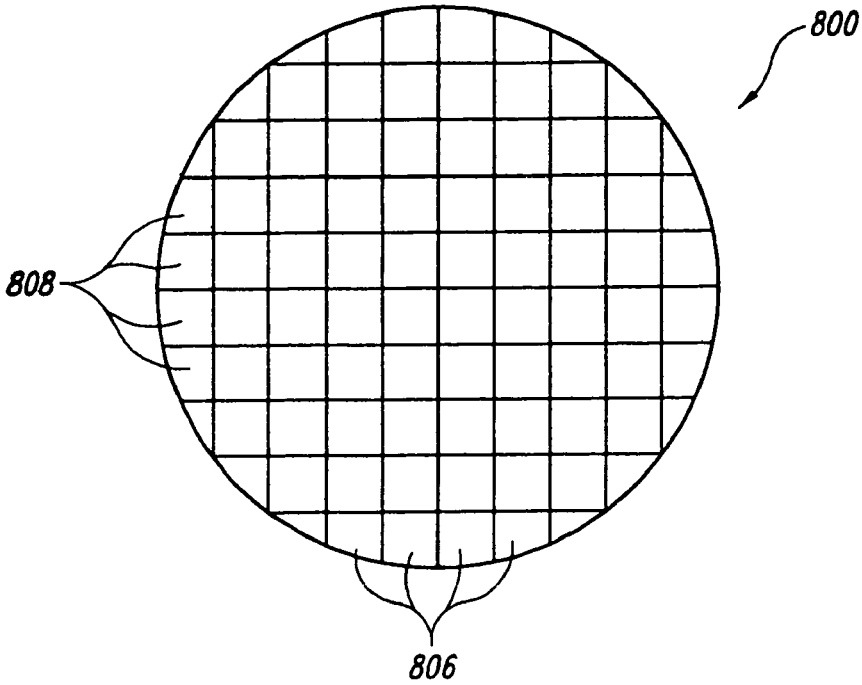
FIG. 7C is a schematic top view of a plurality of magnetic field sources arranged in a grid in accordance with another embodiment of the invention.
Figure 7D:
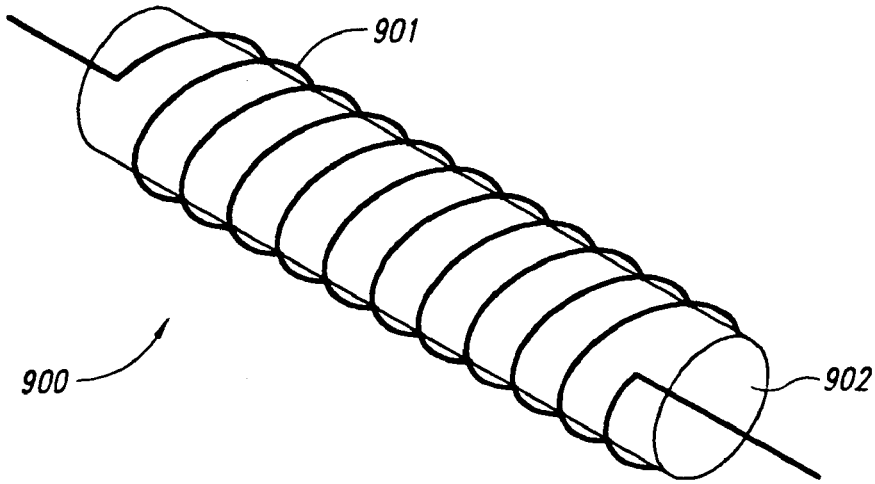
FIG. 7D is a schematic isometric view of a magnetic field source including an electrical coil in accordance with another embodiment of the invention.

FIGS. 7A–7D are schematic views of various magnetic field sources for use with carrier assemblies in accordance with additional embodiments of the invention. For example, FIG. 7A illustrates a single circular magnetic field source 600, such as a permanent magnet or electromagnet. FIG. 7B is a schematic top view of four magnetic field sources (identified individually as 700*a*–*d*) arranged in quadrants. Each magnetic field source 700 can selectively generate a magnetic field. FIG. 7C is a schematic top view of a plurality of magnetic field sources 800 arranged in a grid with columns 806 and rows 808. In other embodiments, the size of each magnetic field source 800 can be decreased to increase the resolution of the magnetic fields. FIG. 7D is a schematic isometric view of a magnetic field source 900 including an electrically conductive coil 901. The magnetic field source 900 can have an air core, or the coil 901 can be wound around an inductive core 902 to form a magnetic field having a higher flux density. In other embodiments, magnetic field sources can have other configurations.

One advantage of the illustrated embodiments is the ability to apply highly localized forces to the workpiece with a quick response time. This highly localized force control enables the CMP process to consistently and accurately produce a uniformly planar surface on the workpiece. Moreover, the localized forces can be changed in situ during a CMP cycle. For example, a polishing machine having one of the illustrated carrier assemblies can monitor the planarizing rates and/or the surface of the workpiece and adjust accordingly the magnitude and position of the forces applied to the workpiece to produce a planar surface. Another advantage of the illustrated carrier assemblies is that they are simpler than existing systems and, consequently, reduce downtime for maintenance and/or repair and create greater throughput.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A method for manufacturing a carrier head for use on a polishing machine to retain a micro-device workpiece during mechanical or chemical-mechanical polishing, comprising:

coupling a magnetic field source configured to generate a magnetic field to the carrier head; and disposing a magnetorheological fluid within a chamber in the carrier head;

wherein disposing the magnetorheological fluid comprises depositing the magnetorheological fluid into first and second fluid cells arranged concentrically within the chamber.

2. The method of claim 1 wherein coupling the magnetic field source comprises coupling an electrically conductive coil to the carrier head.

3. The method of claim 1 wherein coupling the magnetic field source comprising attaching a magnet to the carrier head.

4. The method of claim 1 wherein coupling the magnetic field source comprising attaching an electromagnet to the carrier head.

5. The method of claim 1 wherein coupling the magnetic field source comprising attaching a plurality of magnets to the carrier head with the magnets arranged concentrically.

6. The method of claim 1 wherein coupling the magnetic field source comprising attaching a plurality of magnets to the carrier head with the magnets arranged in a grid.

7. The method of claim 1 wherein coupling the magnetic field source comprising attaching a plurality of magnets to the carrier head with the magnets arranged in quadrants.

8. A method for manufacturing a carrier head for use on a polishing machine to retain a micro-device workpiece during mechanical or chemical-mechanical polishing, comprising:

attaching a plurality of magnetic field sources to the carrier head, wherein the magnetic field sources are configured to generate magnetic fields in the carrier head; and placing a magnetic fluid in a plurality of fluid compartments in the carrier head, wherein the viscosity of the magnetic fluid changes under the influence of a magnetic field.

9. The method of claim 8 wherein placing the magnetic fluid comprises disposing a magnetorheological fluid in the fluid compartments.

10. The method of claim 8 wherein attaching the magnetic field sources comprises arranging the magnetic field sources concentrically in the carrier head.

11. The method of claim 8 wherein attaching the magnetic field sources comprises arranging the magnetic field sources concentrically in the carrier head.

12. The method of claim 8 wherein placing the magnetic fluid in the compartments comprises disposing the magnetic fluid in a plurality of fluid compartments arranged concentrically.

13. The method of claim 8 wherein placing the magnetic fluid in the compartments comprises disposing the magnetic fluid in a plurality of fluid compartments arranged in a grid.

14. A method for manufacturing a carrier head for use on a polishing machine to retain a micro-device workpiece during mechanical or chemical-mechanical polishing, comprising:

disposing a magnetorheological fluid in a plurality of fluid cavities in the carrier head; and coupling a plurality of magnetic field sources to the head such that the individual magnetic field sources are positioned to generate different magnetic fields in corresponding fluid cavities.

15. The method of claim 14 wherein disposing the magnetorheological fluid in the fluid cavities comprises placing the magnetorheological fluid in a plurality of fluid cavities arranged concentrically.

16. The method of claim 14 wherein disposing the magnetorheological fluid in the fluid cavities comprises placing the magnetorheological fluid in a plurality of fluid cavities arranged in a grid.

17. The method of claim 14 wherein coupling the magnetic field sources comprises attaching a plurality of magnetic field sources arranged concentrically.

18. The method of claim 14 wherein coupling the magnetic field sources comprises attaching a plurality of magnetic field sources arranged in a grid.

* * * * *

UNITED STATES PATENT AND TRADEMARK OFFICE

CERTIFICATE OF CORRECTION

PATENT NO. : 7,255,630 B2
APPLICATION NO. : 11/187280
DATED : August 14, 2007
INVENTOR(S) : Elledge It is certified that error appears in the above-identified patent and that said Letters Patent is hereby corrected as shown below:

On the Title page, in Item (62), under "Related U.S. Application Data", in column 1, line 3, delete "2003." and insert -- 2003, now Pat. No. 7,074,114. --, therefor.

In column 8, line 14, in Claim 10, delete "concentrically" and insert -- in a grid --, therefor.

Signed and Sealed this

Twentieth Day of November, 2007

JON W. DUDAS
*Director of the United States Patent and Trademark Office*